US009796104B2

(12) United States Patent
Barsotti Giovanni

(10) Patent No.: US 9,796,104 B2
(45) Date of Patent: Oct. 24, 2017

(54) LOG CLAMPING DEVICE

(71) Applicant: UNIVERSAL TISSUE TECHNOLOGY SRL, Lucca (IT)

(72) Inventor: Bertoli Barsotti Giovanni, Lucca (IT)

(73) Assignee: MTorres Tissue SRL, Lucca (IT)

( * ) Notice: Subject to any disclaimer, the term of this patent is extended or adjusted under 35 U.S.C. 154(b) by 561 days.

(21) Appl. No.: 14/145,084

(22) Filed: Dec. 31, 2013

(65) Prior Publication Data

US 2015/0102545 A1 Apr. 16, 2015

(30) Foreign Application Priority Data

Oct. 16, 2013 (CN) ..... 2013 1 04836910

(51) Int. Cl.
*B26D 7/02* (2006.01)
*B26D 3/16* (2006.01)
*B26D 7/01* (2006.01)

(52) U.S. Cl.
CPC ..... *B26D 7/02* (2013.01); *B26D 3/16* (2013.01); *B26D 2007/013* (2013.01)

(58) Field of Classification Search
CPC .... B26D 7/02; B26D 7/04; B26D 3/16; B25B 5/08; B25B 1/20; B25B 1/08; B23Q 1/76; B23Q 1/763
USPC ..... 269/56, 164, 234, 287, 105, 106, 107, 269/154, 233, 231
See application file for complete search history.

(56) References Cited

U.S. PATENT DOCUMENTS 2,090,234 A * 8/1937 Robinowitz ..... A22C 17/02 24/486
2,262,991 A * 11/1941 Arrigo ..... B26D 3/18 83/385
2,542,676 A * 2/1951 Hunter ..... A42C 1/04 223/12
2,722,250 A * 11/1955 Applegate ..... A47G 33/12 269/152
3,032,331 A * 5/1962 Doty ..... B23Q 3/08 269/107
3,371,952 A * 3/1968 Hunger ..... B66C 1/585 294/106
3,460,329 A * 8/1969 Overstreet, Jr. ..... A01D 46/26 294/115
3,741,517 A * 6/1973 Pogonowski ..... E21B 29/08 166/55
3,823,907 A * 7/1974 Ziaylek, Jr. ..... A62C 13/78 248/313
3,988,865 A * 11/1976 Weisman ..... B25B 5/08 269/196

(Continued)

FOREIGN PATENT DOCUMENTS

CA 2673269 A1 10/2010
CN 200960676 Y 10/2007

(Continued)

*Primary Examiner* — Larry E Waggle, Jr.
*Assistant Examiner* — Tyrone V Hall, Jr.
(74) *Attorney, Agent, or Firm* — Jeffrey Dean Lindsay

(57) ABSTRACT

A clamping device is described for clamping a log such as a log of wound material. The inventive clamping device addresses the need for more efficient or flexible clamping systems for logs of wound material that may vary in their diameter, wherein the clamping allows the logs to be cut by a cutting machine to sections of desired length.

13 Claims, 5 Drawing Sheets

(56) References Cited

U.S. PATENT DOCUMENTS 4,339,116 A * 7/1982 Benz ..... B25B 5/147 269/130
4,463,635 A * 8/1984 Hafla ..... B23Q 1/76 294/116
4,519,279 A * 5/1985 Ruggeri ..... B23Q 1/76 294/116
4,546,681 A * 10/1985 Owsen ..... B23Q 1/76 294/116
H45 H * 4/1986 Gilmore ..... B24B 23/00 30/392
4,705,331 A * 11/1987 Britton ..... B63C 11/40 24/463
4,877,228 A * 10/1989 Ripert ..... H01R 43/28 269/156
5,038,647 A 8/1991 Biagiotti
5,228,490 A * 7/1993 Wolf ..... B27B 1/00 144/3.1
5,315,907 A 5/1994 Biagiotti
5,647,259 A * 7/1997 Biagiotti ..... B26D 3/16 269/132
6,227,086 B1 * 5/2001 Lumberg ..... B26D 7/02 269/288
6,244,643 B1 * 6/2001 Tillaart ..... B66C 1/585 294/206
6,532,851 B2 * 3/2003 Moss ..... B26D 7/02 83/457
6,883,766 B1 * 4/2005 Ziaylek ..... A62B 9/04 248/154
6,896,603 B1 * 5/2005 Lessway ..... B23Q 1/76 451/406
7,617,852 B2 11/2009 Perini
8,261,646 B2 9/2012 De Matteis
8,474,806 B2 * 7/2013 Orgeron ..... B25B 5/061 269/218
8,833,219 B2 * 9/2014 Pierce ..... B23D 57/0007 30/102
8,950,306 B2 * 2/2015 Gambini ..... B26D 7/02 83/457

FOREIGN PATENT DOCUMENTS

| | | | |
|---|---|---|---|
| CN | 201147939 | Y | 11/2008 |
| CN | 102699944 | A | 10/2012 |
| DE | 4213553 | A1 | 11/1992 |
| EP | 0391865 | B1 | 8/1995 |
| EP | 0603139 | B1 | 3/1997 |
| EP | 0982105 | A1 | 3/2000 |
| EP | 1302275 | A2 | 4/2003 |
| EP | 1582320 | A1 | 10/2005 |
| EP | 2489486 | A1 | 8/2012 |
| EP | 2602074 | A1 | 6/2013 |
| EP | 2623279 | A1 | 8/2013 |
| GB | 547112 | | 8/1942 |
| GB | 2181984 | A | 5/1987 |
| WO | 2014/016724 | A1 | 1/2014 |

* cited by examiner

LOG CLAMPING DEVICE

BACKGROUND

1. Technical Field

The present disclosure generally relates to a log clamping device, and more particularly to a log clamping device associated with a cutting machine. The cutting machine is applied to cut "logs" comprising web material wound on tubular winding cores. The log clamping device clamps the log in the cutting process.

2. Description of the Related Art

In typical applications, a log such as a wound tissue log is cut into rolls of smaller size by a rotating circular knife in a cutting machine. The log is held and supported by a clamping device in the cutting process.

A typical clamping device is configured for securing logs of constant size. Related structures of prior clamping devices may need to be replaced when the size of the logs is changed in order to properly clamp, making it inconvenient or inefficient to change log diameters. Therefore, there is a need for more efficient or flexible clamping systems for cutting logs.

DETAILED DESCRIPTION OF EMBODIMENTS

Figure 1:
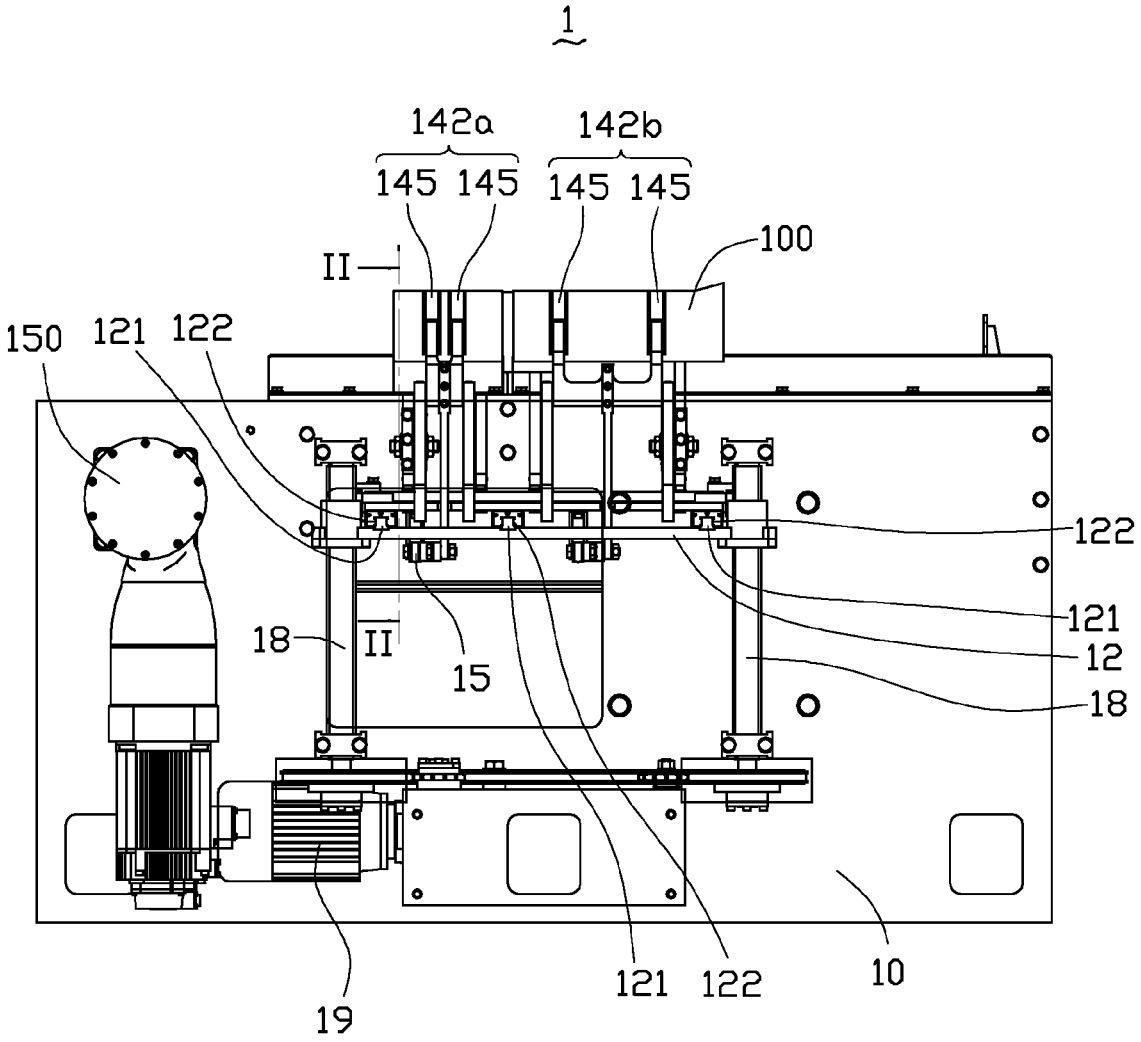
FIG. 1 is a front-side view of a clamping device of an exemplary embodiment of the present disclosure, wherein logs are shown in the clamping device.
Figure 2:
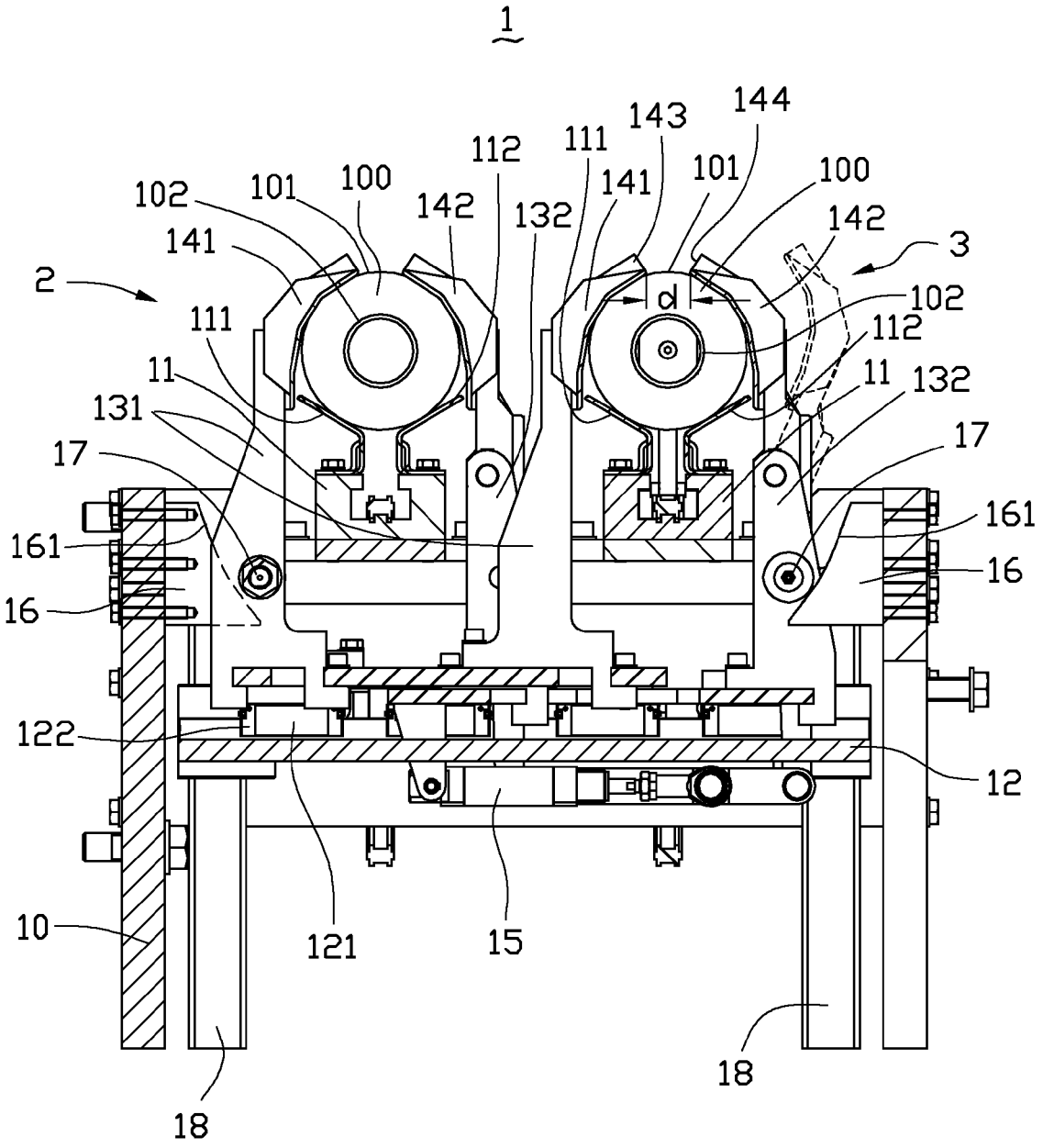
FIG. 2 is a cross-sectional view of the clamping device of FIG. 1, taken along line II-II thereof.

Referring to FIG. 1 and FIG. 2, a clamping device 1 in accordance with an exemplary embodiment of the present disclosure is shown for holding and supporting a circumferential surface 101 of a log 100 in a cutting process, in which the log 100 is cut by a cutting machine into rolls of smaller sizes. The log 100 can be a tissue log or other kinds of web material wound on a tubular winding core 102.

The clamping device shown in FIG. 2 has two clamping units 2 and 3 for holding two lanes of logs 100. The two clamping units 2 and 3 have similar structures. In alternative embodiments, the clamping device may have one clamping unit for holding a single log 100, or may be provided with more than two clamping units for holding more than two logs 100.

The clamping device having one clamping unit is set forth as an example for a detailed description as follows. The clamping device comprises a frame 10, a supporting arm 11 fixed on the frame 10, a base plate 12, a pair of cradles 131, 132 disposed on the base plate 12 and a pair of clamps 141, 142 respectively connected to the cradles 131, 132. The clamp 141 is fixed on the cradle 131. The clamp 142 is pivotably connected to the cradle 132, and is capable of rotating and shifting between a clamping position and an open position. The log 100 is supported on the supporting arm 11. As shown in FIG. 2, when the clamp 142 is in the clamping position, the supporting arm 11 locates at a bottom of the circumferential surface 101 of the log 100 and the clamps 141, 142 are symmetrically located at opposite sides of the circumferential surface 101 of the log 100. The supporting arm 11 and the clamps 141, 142 cooperate to secure the log 100 for facilitating the cutting process of the log 100. When the clamp 142 is in the open position (dotted lines shown in FIG. 2), the log 100 will be unrestrained among the supporting arm 11 and the clamps 141, 142. The supporting arm 11, in typical embodiments, does not move vertically when the base plate 12 moves vertically, but remains at a substantially constant elevation to support logs. In one embodiment, when the clamp 142 is in the open position, the minor distance d between the clamps 141, 142 (i.e., the distance d between free ends 143, 144 of the clamps 141, 142 as shown in FIG. 2) is larger than the diameter of the log 100 for allowing the log 100 to move between the clamps 141, 142 more easily to allow new regions of the log 100 to be cut.

Multiple pairs of cradles and clamps can be arranged along the axial direction of the log 100 as desired. Two clamps 142*a*, 142*b* are shown in FIG. 1 and are distributed along the axial direction of the log 100. Accordingly, the supporting arm 11 can extend to a predetermined length along the axial direction of the log 100 for holding the log 100.

For conforming with the circumferential surface 101 of the log 100, the clamps 141, 142 may have a curved shape in some embodiments. The clamps 141, 142 can be configured to include sub-clamps for increasing a contacting surface between the clamps 141, 142 and the log 100. The clamps 142*a*, 142*b* shown in FIG. 1 each have two sub-clamps 145 and in some embodiments may present a U shape or other suitable shapes. The distance between the sub-clamps 145 of the clamp 142*a* is smaller than that of the clamp 142*b*. Alternatively, the clamp 141 can have a similar structure to the clamp 142, but need not similar but may have any suitable shape known in the art. In addition, the cradles 131, 132 can each include sub-cradles for connecting a corresponding sub-clamp 145.

The clamp 142 is connected to an actuator 15. The actuator 15 drives the rotation of the clamp 142 relative to the cradle 132 between the clamping position and the open position.

The actuator 15 is positioned beneath the base plate 12, and penetrates through the base plate 12 to connect the clamp 142. The actuator 15 can be a pneumatic cylinder, a hydraulic cylinder or other equivalent structures. A motor 150 is used to move a pusher (not shown) that moves the log 100 into position to be clamped and moves the log 100 away from the clamps 141, 142 after cutting is completed.

The supporting arm 11 extends upwardly from the frame 10 and comprises two branches 111, 112. The section profile of the supporting arm 11 is substantially a Y shape or a V shape, though other shapes may be contemplated such as a more curved, less angular shape capable of holding the log 100. The branches 111, 112 contact and help support the bottom of the circumferential surface 101 of the log 100.

Figure 4:
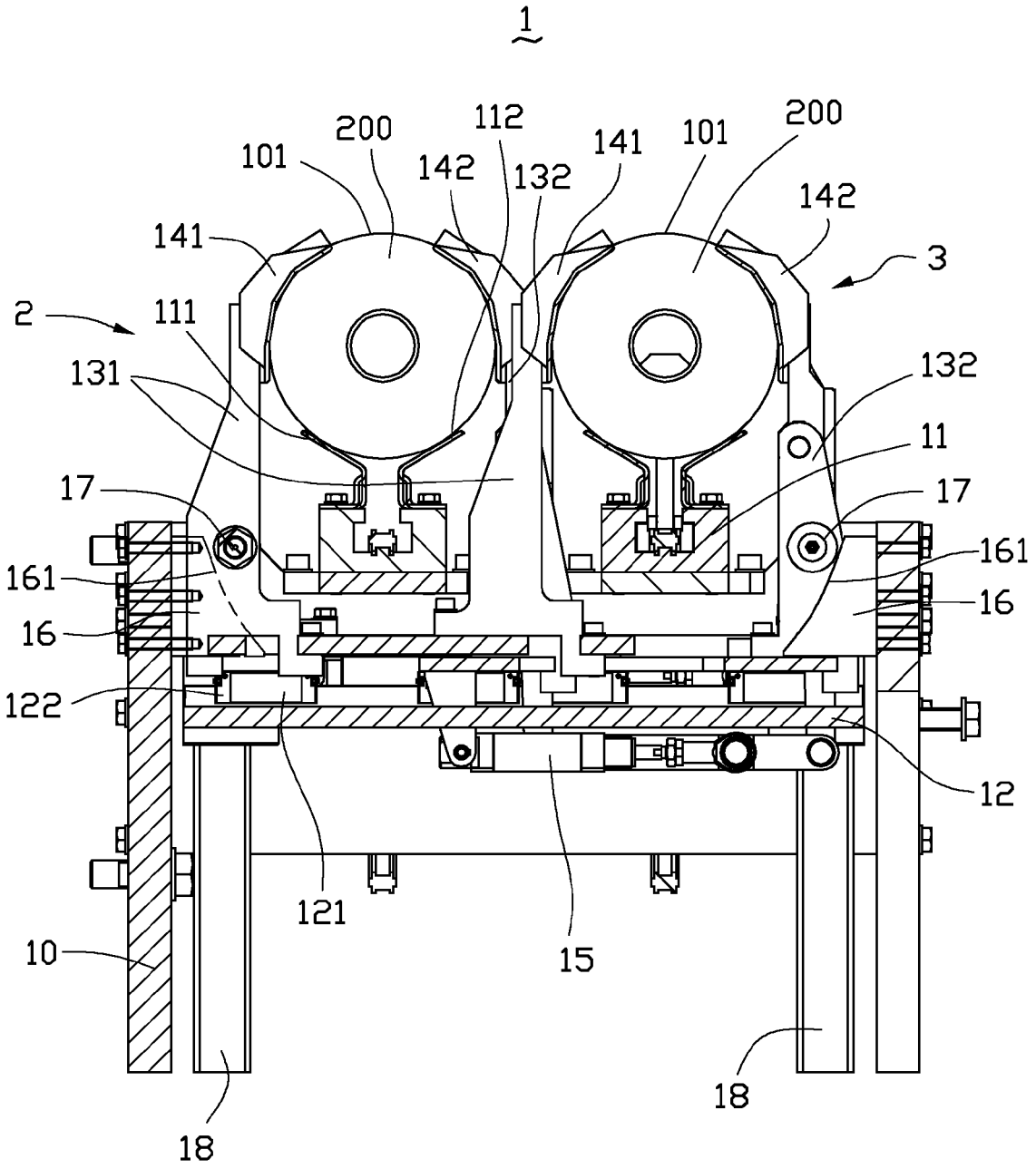
FIG. 4 is a cross-sectional view of the clamping device of FIG. 3, taken along line IV-IV thereof.

In some embodiments such as the embodiment shown in FIG. 2 and FIG. 4, the clamping device may further comprise a cam mechanism corresponding to each cradle 131 (132). The cam mechanism comprises a profile 16 fixed on the frame 10, and a follower 17 disposed on the cradle 131(132) to match with the profile 16. The profiles 16 for the two cam mechanisms corresponding to the cradles 131, 132 may be symmetrical relative to the center of the two clamping units 2, 3, as shown in FIG. 2 and FIG. 4, or, in other words, can be mirror images of one another reflected about a vertical plane parallel to the axis of the logs and normal to the plane of FIG. 2, passing through a central region of the clamping device. The profile 16 shown in the embodiment has a bottom end near the base plate 12 and an opposite top end far from the base plate 12. The profile 16 as depicted has a surface 161 matching with the follower 17, and gradually slant from the bottom end to the top end thereof. Of course, a wide variety of other profile shapes can be used, including substantially linear profiles and profiles with more complex curves or both linear and curved sections. The distance between the two profiles 16 increases gradually from the bottom ends to the top ends thereof. When the follower 17 moves along the surface 161 of the corresponding profile 16, the distance between the two cradles 131, 132 is changed gradually. More specifically, when the follower 17 moves upwardly along the surface 161 from the bottom end to the top end of the profile 16, the distance between the cradles 131, 132 is increased gradually. When the follower 17 moves downwardly along the surface 161 from the top end to the bottom end of the profile 16, the distance between the cradles 131, 132 is decreased gradually.

The base plate 12 is moveably connected to at least one post 18. FIG. 2 shows two posts 18 connecting the base plate 12. When the base plate 12 moves along the posts 18 downward or upward, as a result, the distance between the base plate 12 and the supporting arm 11 and the distance between the clamps 141, 142 and the supporting arm 11 is changed, thereby allowing the clamping device to be suitable for clamping logs 100 with different diameters.

In the present embodiment, the posts 18 are depicted as screws, and the base plate 12 is threadedly engaged with the posts 18, though other mechanisms may be used for moving the base plate 12. The posts 18 as shown can be rotated by a motor 19, and the base plate 12 is moved along the posts 18. The motor 19 can be fixed on the frame 10.

The cradles 131, 132 are moveably connected to the base plate 12. For example, the cradles 131, 132 can be slidably disposed on the base plate 12. In the present embodiment, rails 121 and tracks 122 are formed between the cradles 131, 132 and the base plate 12 to accomplish the slidable movement between the cradles 131, 132 and the base plate 12.

The follower 17 is rotatably arranged on the cradle 131, 132 and engages with the surface 161 of the profile 16 fixed on the frame 10. Through the motion of the follower 17, the cradle 131, 132 can slide on the base plate 12, and the distance between the clamps 141, 142 (as well as that between the cradles 131, 132) can be changed. The follower 17 can also be controlled to stop at a desired position to maintain a fixed distance between the cradles 131, 132. In alternate embodiments, the follower 17 can be driven directly by a motor (not shown) or other power supply or other device such as an airbag or pneumatic cylinder (not shown).

With the upward or downward movement of the base plate 12 relative to the supporting arm 11, the distance between the clamps 141, 142 and the supporting arm 11 (i.e., the vertical position of the clamps 141, 142, the cradles 131, 132, and the base plate 12) can be adjusted. At the same time, with the rotation of the follower 17, the cradles 131, 132 can slide on the base plate 12 and the distance between the cradles 131, 132 (i.e., the horizontal position of the cradles 131, 132 and the clamps 141, 142) can be adjusted. As a result, the supporting arm 11 and the clamps 141, 142 can be adjusted to hold and support logs 100 with different diameter, and there is no need to replace relative parts of the clamping device, which is more convenient and rapid in production.

The operation principles of the clamping device provide in the present disclosure will be more detailed described as follows with FIG. 3 and FIG. 4. The logs 200 shown in FIG. 3 and FIG. 4 have a larger diameter than the logs 100 shown in FIG. 1 and FIG. 2.

Figure 3:
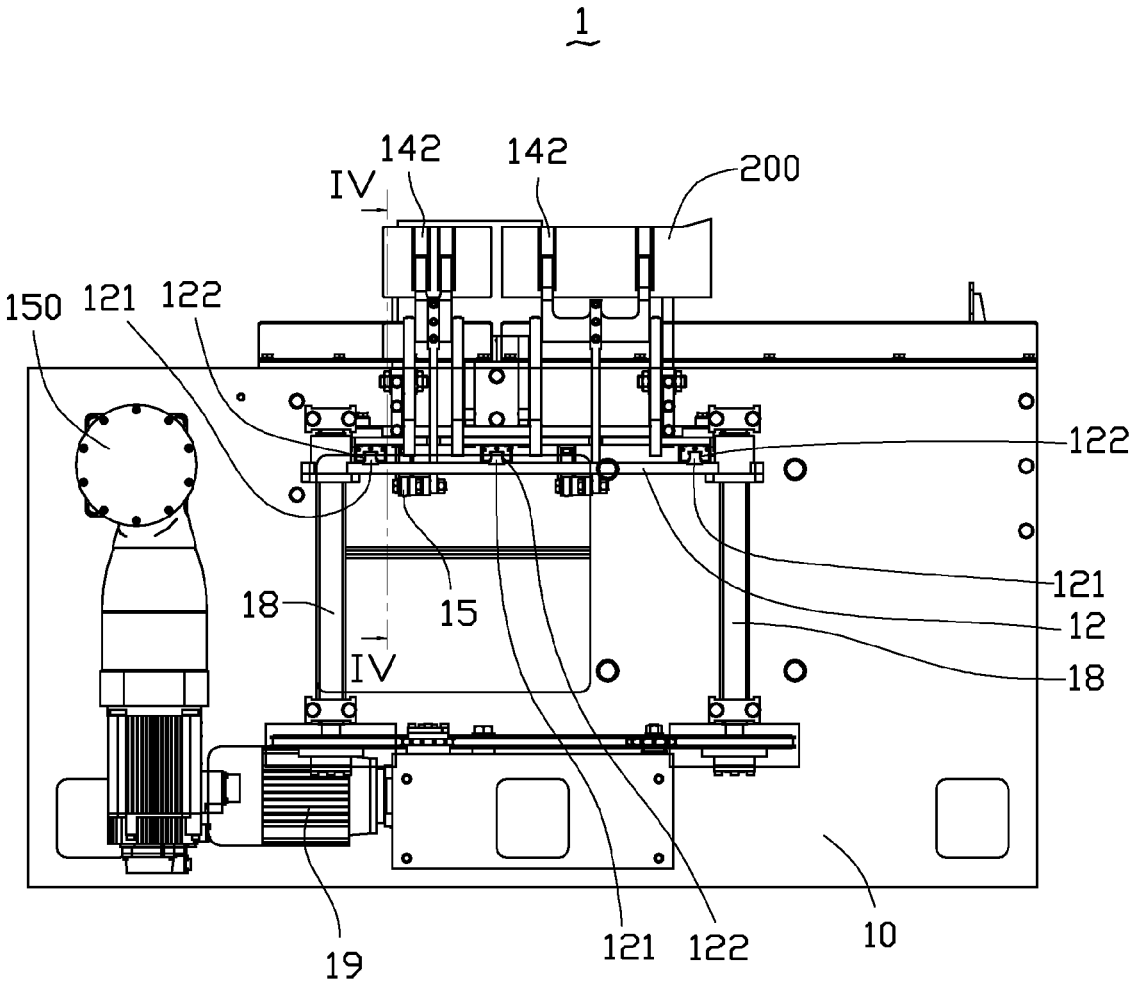
FIG. 3 is another front-side view of the clamping device of FIG. 1, wherein the diameter of the logs is larger than that in FIG. 1.

If the clamping device as shown in FIG. 1 and FIG. 2 needs to hold and support the logs 200 as shown in FIG. 3 and FIG. 4, the posts 18 rotate, and the base plate 12 moves upwardly to increase the distance between the supporting arm 11 and the clamps 141, 142; at the same time, the follower 17 rotates and moves upwardly along the surface 161 of the profile 16, and the cradles 131, 132 slide on the base plate 12, whereby the distance between the cradles 132, 132 and between the clamps 141, 142 is increased. After the rotation of the clamp 142, where the clamp 142 is in the open position, the log 200 can be inserted among the supporting arm 11 and the clamps 141, 142. The log 200 is then secured by the supporting arm 11 and the clamps 141, 142 after a reversed rotation of the clamp 142, where the clamp 142 is in the clamping position.

Figure 5:
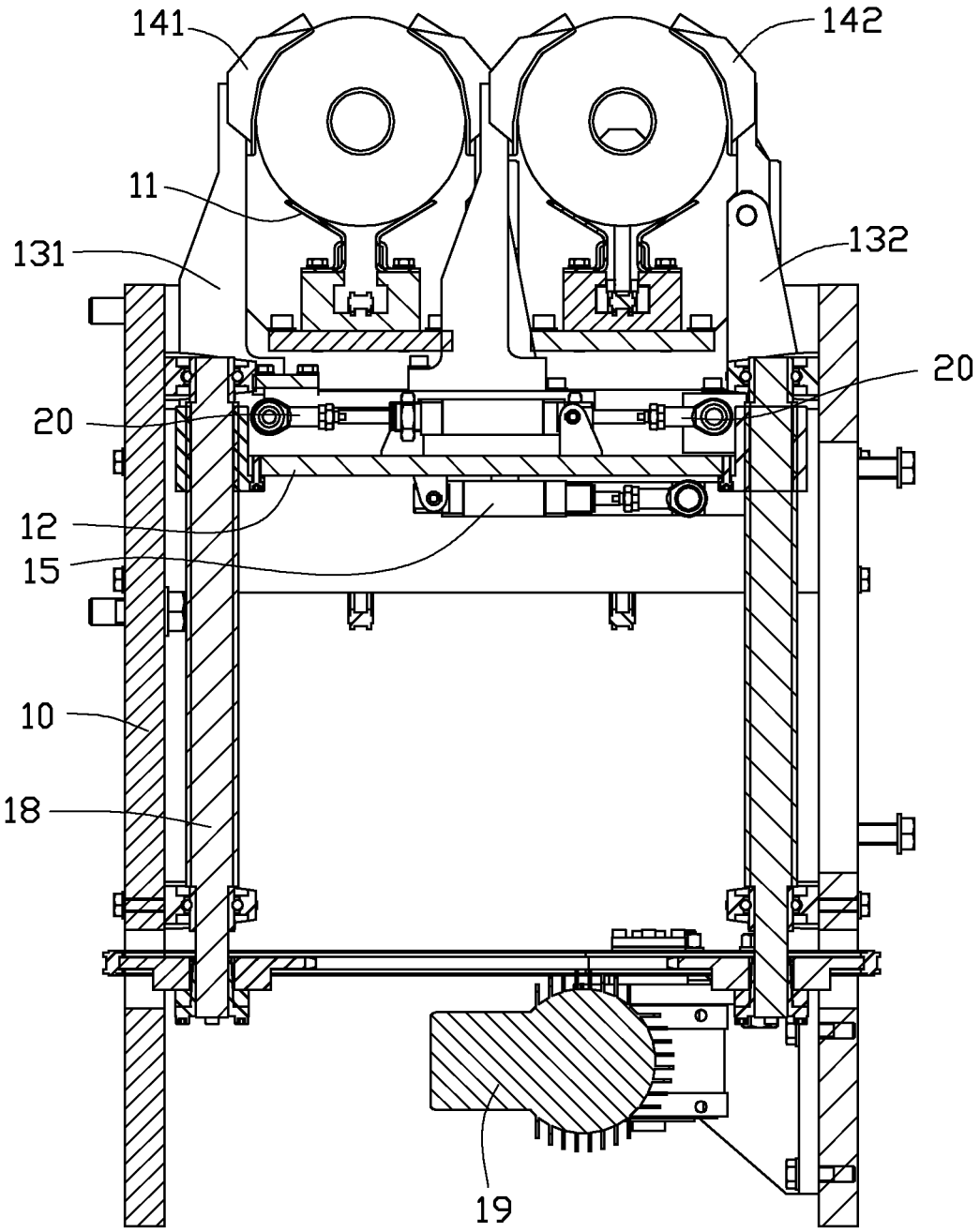
FIG. 5 is a cross-sectional view of a clamping device of another exemplary embodiment of the present disclosure.

In the above embodiment, the cradles 131, 132 are moveably arranged on the frame 10 via the cam mechanisms to change the horizontal positions thereof. It is noted that the cradles 131, 132 can be moveably arranged on the frame 10 in different manners, including configurations without the need for the profile 16 and the follower 17 of FIG. 2. Referring to the alternative embodiment shown in FIG. 5, each cradle 131, 132 is connected to a cradle actuator 20. The cradle actuator 20 may be an electric, pneumatic, or hydraulic actuator, and may comprise an electric motor. The horizontal positions of the cradles 131, 132 on the base plate 12 can be changed by the driving of the cradle actuator 20. In other words, the distance between the cradles 131, 132 can be adjusted by the driving of the cradle actuator 20. In such way, the horizontal positions of the cradles 131, 132 and the vertical positions of the cradles 131, 132 can be controlled independently.

In alternative embodiments, the cradle actuator 20 can be a rack and pinion system formed between the cradles 131, 132 and the base plate 12.

Further, the moveable connection between the base plate 12 and the post 18 is not limited to screws. Other systems such as linear actuators, or rack and pinion can also be formed between the base plate 12 and the post 18 to accomplish the vertical position adjustment of the base plate 12.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A clamping device for clamping a log, the clamping device comprising:

a frame;

a supporting arm fixed on the frame for supporting the log;

a pair of clamps for clamping the log;

at least one post;

a base plate for carrying the pair of clamps, the pair of clamps moveably disposed on the base plate for changing a distance between the clamps and the pair of clamps moveably disposed on the base plate to adjust a horizontal position thereof, and the base plate moveably disposed on the frame for changing a distance between the clamps and the supporting arm, wherein the at least one post is a screw and the base plate is moveably connected to the at least one post, being threadedly engaged therewith, and wherein the base plate moves relative to the frame via rotation of the at least one post.

2. A clamping device for clamping a log, the clamping device comprising:

a frame;

a supporting arm fixed on the frame for supporting the log;

a pair of clamps for clamping the log;

a base plate for carrying the pair of clamps, the pair of clamps moveably disposed on the base plate for changing a distance between the clamps, and the base plate moveably disposed on the frame for changing a distance between the clamps and the supporting arm; and a pair of cradles moveably disposed on the base plate, the pair of clamps connecting to the pair of the cradles respectively, wherein one clamp is fixed onto one cradle, and another clamp is pivotably connected to another cradle and capable of rotating between a clamping position and an open position.

3. A clamping device for clamping a log, the log having a circumferential surface, the clamping device comprising: a frame; a supporting arm fixed on the frame for holding a bottom of the circumferential surface of the log; at least one post; a base plate moveably formed on the at least one post to adjust a vertical position thereof; and at least one pair of clamps for symmetrically clamping opposite sides of the circumferential surface of the log, the at least one pair of clamps moveably disposed on the base plate to adjust a horizontal position thereof.

4. The clamping device of claim 3 further comprising at least one pair of cradles moveably disposed on the base plate, wherein each clamp is connected to a corresponding cradle.

5. The clamping device of claim 4, wherein a rail and a track are formed between the cradle and the base plate to provide a slidable movement between the corresponding cradle and the base plate.

6. The clamping device of claim 5, wherein a follower is rotatably formed on each cradle, a profile is fixed on the frame corresponding to the follower, the profile has a surface on which the follower moves along to change a position of the cradle on the base plate, thereby changing a position of a corresponding clamp on the base plate.

7. The clamping device of claim 5, wherein a cradle actuator is connected to each cradle for changing a horizontal position of the cradle on the base plate.

8. The clamping device of claim 4, wherein one clamp of the at least one pair of clamps is fixed onto one cradle of the at least one pair of cradles, and another clamp of the at least one pair of clamps is pivotably connected to another cradle of the at least one pair of cradles and capable of rotating between a clamping position and an open position.

9. The clamping device of claim 8 further comprising a motor and an actuator connecting the another clamp of the at least one pair of clamps, the actuator transferring power provided by the motor to the another clamp of the at least one pair of clamps to drive the rotation of the another clamp of the at least one pair clamps between the clamping position and the open position.

10. The clamping device of claim 9, wherein the motor is fixed on the frame, and the actuator is positioned beneath the base plate, and penetrates through the base plate to connect the another clamp of the at least one pair clamps.

11. The clamping device of claim 3, wherein the at least one post is a screw, the base plate is threadedly engaged with the at least one post, and the base plate moves relative to the frame via the rotation of the at least one post to change a vertical position of the base plate, thereby changing a vertical position of the at least one pair of clamps.

12. The clamping device of claim 11 further comprising a motor for driving the at least one post.

13. The clamping device of claim 12, wherein the motor is fixed on the frame.

* * * * *